US006902451B1

(12) United States Patent
Theisen

(10) Patent No.: US 6,902,451 B1
(45) Date of Patent: Jun. 7, 2005

(54) MARINE PROPULSION SYSTEM WITH VERTICAL ADJUSTMENT WITHOUT REQUIRING A U-JOINT

(75) Inventor: Thomas G. Theisen, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/752,289

(22) Filed: Jan. 6, 2004

(51) Int. Cl.[7] ..... B63H 20/14
(52) U.S. Cl. ..... 440/75
(58) Field of Search ..... 440/53, 75, 83, 440/111, 112

(56) References Cited

U.S. PATENT DOCUMENTS

| | | | | |
|---|---|---|---|---|
| 3,447,504 | A * | 6/1969 | Shimanckas | 440/75 |
| 3,946,698 | A * | 3/1976 | LaFollette et al. | 440/60 |
| 4,297,097 | A | 10/1981 | Kiekhaefer | |
| 4,850,911 | A * | 7/1989 | Nakahama et al. | 440/86 |
| 4,865,569 | A * | 9/1989 | Newman | 440/53 |
| 5,647,780 | A | 7/1997 | Hosoi | |
| 5,934,955 | A | 8/1999 | Heston | |
| 6,019,649 | A | 2/2000 | Friesen et al. | |
| 6,352,457 | B1 * | 3/2002 | Higby et al. | 440/86 |
| 6,383,043 | B1 | 5/2002 | Heston | |

FOREIGN PATENT DOCUMENTS

| | | |
|---|---|---|
| WO | WO 91/19644 | 6/1991 |
| WO | WO 94/00340 | 6/1993 |
| WO | WO 99/22989 | 11/1998 |

* cited by examiner

*Primary Examiner*—Andrew D. Wright
(74) *Attorney, Agent, or Firm*—William D. Lanyi

(57) ABSTRACT

A marine propulsion system is provided with a transom housing, an intermediate housing, and a drive shaft housing which are rotatable relative to each other. A gearcase is provided which is rotatable, about a drive shaft axis, relative to the drive shaft housing. By selectively rotating the housings relative to each other, the gearcase can be raised or lowered without changing the angle of the drive shaft relative to a horizontal plane. In addition, the gearcase can be trimmed or tilted to a wide variety of angles relative to the transom housing 70.

30 Claims, 6 Drawing Sheets

MARINE PROPULSION SYSTEM WITH VERTICAL ADJUSTMENT WITHOUT REQUIRING A U-JOINT

BACKGROUND OF THE INVENTION

1. Field of the Invention

The present invention relates generally to a marine propulsion system and, more particularly, to a stern drive unit that provides the capability of adjusting the propeller position vertically without the necessity of providing a U-joint to permit this capability.

2. Description of the Prior Art

Those skilled in the art of marine propulsion systems are aware that most stern drive systems require the use of a U-joint to allow the marine propulsion system to be trimmed, tilted, and steered. Those skilled in the art are also aware that most known stern drive systems do not allow the propeller to be raised or lowered from its normal position without also trimming the drive unit. In addition, those skilled in the art are aware that the steering axis of most known stern drive systems is closer to the transom of a marine vessel than to the intersection between the propeller shaft and the drive shaft which is connected to the propeller shaft.

U.S. Pat. No. 5,647,780, which issued to Hosoi on Jul. 15, 1997, describes a vertically adjustable stern drive for a water craft. The marine stern drive includes a tilt/trim and lift adjustment mechanism which raises and lowers the drive while maintaining an established trim angle. The adjustment mechanism includes a parallelogram linkage system. An upper lever of the linkage system is defined in part by a pair of tilt and trim actuators which vary the length of the upper linkage to adjust the trim position of the stern drive and for tilt up. A lower lever of the linkage system is defined between two flexible couplings of a propulsion drive train. One of the flexible couplings is coupled to a lower drive unit of the stern drive which permits the lower lever to rotate without changing the trim angle of the lower drive unit.

U.S. Pat. No. 4,297,097, which issued to Kiekhaefer on Oct. 27, 1981, discloses a stern drive mechanism. The stern drive installation includes a mounting bracket assembly for securing to the transom of a watercraft. The bracket assembly is provided with a transverse horizontal bore rearwardly of the transom for receiving one end of the horizontal cylinder portion of the upper housing of the drive unit. A bracket assembly addition is provided with a horizontal bore which rotatably receives the opposite end of the horizontal cylindrical portion of the upper housing and is secured to the bracket assembly. The bracket assembly and the addition thereto serve to rotatably support the drive unit and provide for tilt movement of the unit on a horizontal transverse axis. The lower housing of the drive unit is dirigibly connected to the upper housing for support and to provide for pivotal movement of the lower housing relative to the upper housing to provide for steering control of the water craft.

U.S. Pat. No. 6,019,649, which issued to Friesen et al. on Feb. 1, 2000, describes an adjustable propeller system. The system includes an outboard drive portion having a propeller. At least one linearly extendable and retractable trim arm is mounted between an outboard plate and the propeller to adjust the trim angle between the outboard plate and the propeller. An upper arm and a lower arm are each pivotally mounted to a transom mounting plate and typically mounted to the outboard mounting plate. The upper and lower arm are linearly extendable and retractable to adjust the depth of the outboard drive portion.

U.S. Pat. No. 6,383,043, which issued to Heston on May 7, 2002, describes a vertical trim system for marine outdrives. A vertical trim system for a marine inboard-outboard outdrive includes a transom plate and arms having first ends attached to the transom plate and second hands attached to a gimbal ring of the outdrive.

U.S. Pat. No. 5,934,955, which issued to Heston on Aug. 10, 1999, describes a vertical trim system for marine outdrives. The system, for a marine inboard-outboard outdrive, includes a transom plate defining an opening therethrough and having first and second sides, the first side adapted to be mounted to a boat transom. At least one arm includes first and second ends, the first end being pivotally coupled to the second side of the transom plate, such that the arm pivots about a horizontal axis. The second end of the arm is adapted to be pivotally coupled to a gimbal ring of an outdrive.

International Patent Application WO 94/00340, which was filed on Jun. 22, 1993, describes a boat propulsion unit comprising a suspension arrangement and a propeller drive shaft housing which, via a lower and an upper universal joint, are pivotally connected to each other. The suspension arrangement comprises a hollow frame member in the form of an extruded aluminum profile which is fixed around an opening in a boat transom, and a carrier attached to the frame member, said carrier covering the opening and supporting said pivot means. The frame member presents inlets and outlets for exhaust gases.

International Patent Application WO 99/22989, which was filed on Nov. 3, 1998, describes an omni-directional horizontal thrust adjustable marine propulsion system. The system is capable of providing independent control of propeller elevation, trim and steering utilizes a set of pivotally connected, independent frames. A pair of elevational hydraulic rams are connected between the vessel and the frame support for controlling the lift of the propeller. A trim hydraulic ram, coupled between the support frame and the upper gearcase controls the trim. Directional control is provided by a drive shaft coupled between the gear cases.

International Patent Application WO 91/19644, which was filed on Jun. 20, 1991, describes an arrangement in connection with a swingable turn-up inboard/outboard stern aggregate for a craft. An arrangement in a swingable turn-up inboard/outboard stern aggregate for a craft with an inboard engine and an outboard driving means comprises a screw, where the inboard driving shaft of the stern aggregate for connection with the engine is connected with a screw shaft which is approximately horizontal in a position for use and is mounted in the lower end of a housing by the aid of a transmission shaft, which is divided into two sections and surrounded by a housing. The first section is at one end mounted in the upper end of the housing and connected with the driving shaft, via a first universal joint, and is at its other end, via an angular gear, connected with an upper end of a section which is inclined rearwards and downwards. The lower end of the second section is connected with a screw shaft at a firm angle, via a transmission means of torsional moment. In connection with the angular gear comprising two sets of angular gear wheels, a reversing means is provided to reverse the direction of rotation of the lower section and, thus, the direction of movement of the craft.

The patents described above are hereby expressly incorporated by reference in the description of the present invention.

In certain types of marine propulsion systems, the U-joint is susceptible to wear and damage. Most known stern drive systems require the use of at least one U-joint in order to allow the system to move for the purpose of trimming or steering the drive unit relative to the transom of a boat. In addition, most known stern drive systems do not allow for the raising or lowering of a propeller shaft without a corresponding change in the trim of the drive. Typically, changing the elevation of the propeller shaft relative to the boat requires significant changes to the overall marine propulsion system.

It would therefore be significantly beneficial if a marine propulsion system could be provided which allows a stern drive unit to be raised or lowered without requiring a change in the trim angle of the drive unit. It would also be significantly beneficial if the stern drive unit could be provided which allows the propeller shaft to be steered about a steering axis which is coincident with the generally vertical drive shaft axis of rotation.

SUMMARY OF THE INVENTION

A marine propulsion system, made in accordance with a preferred embodiment of the present invention, comprises an input shaft which is connectable in torque transmitting relation with an engine. It also comprises a first intermediate shaft which is connected in torque transmitting relation with the input shaft and is rotatable about a first axis of rotation. It comprises a second intermediate shaft which is connected in torque transmitting relation with the first intermediate shaft and is rotatable about a second axis of rotation. The first and second axes of rotation of the first and second intermediate shafts are generally parallel to each other. The present invention further comprises a drive shaft which is connectable in torque transmitting relation with a second intermediate shaft.

In a particularly preferred embodiment of the present invention, it further comprises a propeller shaft connected in torque transmitting relation with the drive shaft. The input shaft is generally perpendicular to the first intermediate shaft. The present invention further comprises a first spur gear attached to the first intermediate shaft and a second spur gear attached to the second intermediate shaft. The first and second spur gears are connected in tooth meshing relation with each other.

A preferred embodiment of the present invention further comprises a first bevel gear connected in torque transmitting relation with the second intermediate shaft to rotate in a first direction and a second bevel gear connected in torque transmitting relation with a second intermediate shaft to rotate in a second direction. It further comprises a clutch which is moveable between a first position to cause the drive shaft to rotate in a first direction and a second position to cause the drive shaft to rotate in a second direction. The first bevel gear is connected in torque transmitting relation with the drive shaft when the clutch is in the first position and the second bevel gear is connected in torque transmitting relation with the drive shaft when the clutch is in the second position. The clutch is connected in torque transmitting relation with the drive shaft by a plurality of splines formed on the clutch and on the drive shaft.

A preferred embodiment of the present invention further comprises a drive shaft bevel gear attached to the drive shaft and a propeller shaft bevel gear attached to the propeller shaft. The drive shaft bevel gear is disposed in tooth meshing relation with the propeller shaft bevel gear.

A preferred embodiment of the present invention further comprises a transom housing which is attachable to a transom of a marine vessel. The input shaft is supported for rotation about an input shaft axis of rotation by the transom housing. A drive shaft housing is also provided. The drive shaft and the first and second bevel gears are supported for rotation about the drive shaft axis of rotation by the drive shaft housing. The present invention also comprises an intermediate housing. The first and second intermediate shafts are supported for rotation about the first and second axes of rotation by the intermediate housing.

The present invention further comprises a first hydraulic cylinder connected between the drive shaft housing and the intermediate housing. A gearcase is also provided. The propeller shaft is supported for rotation about a propeller shaft axis of rotation by the gearcase and the propeller shaft bevel gear is supported for rotation about the drive shaft axis of rotation by the gearcase. The present invention further comprises a hydraulic actuator connected between the drive shaft housing and the gearcase for causing the gearcase to rotate about the drive shaft axis of rotation. A second hydraulic cylinder is connected between the transom housing and the intermediate housing. The intermediate housing is rotatable relative to the transom housing and the drive shaft housing is rotatable relative to the intermediate housing.

An embodiment of the marine propulsion system made in accordance with the present invention can comprise an input shaft which is connectable in torque transmitting relation with an engine, a drive shaft which is connectable in torque transmitting relation with the input shaft, and a propeller shaft connectable in torque transmitting relation with the drive shaft. The propeller shaft is rotatable about a drive shaft axis of rotation. The drive shaft is supported for rotation about the drive shaft axis of rotation by a drive shaft housing. The propeller shaft is supported for rotation about a propeller shaft axis of rotation by a gearcase, wherein the gearcase is rotatable about the drive shaft axis of rotation relative to the drive shaft housing. A hydraulic actuator is connected between the drive shaft housing and the gearcase for causing the gearcase to rotate about the drive shaft axis of rotation.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
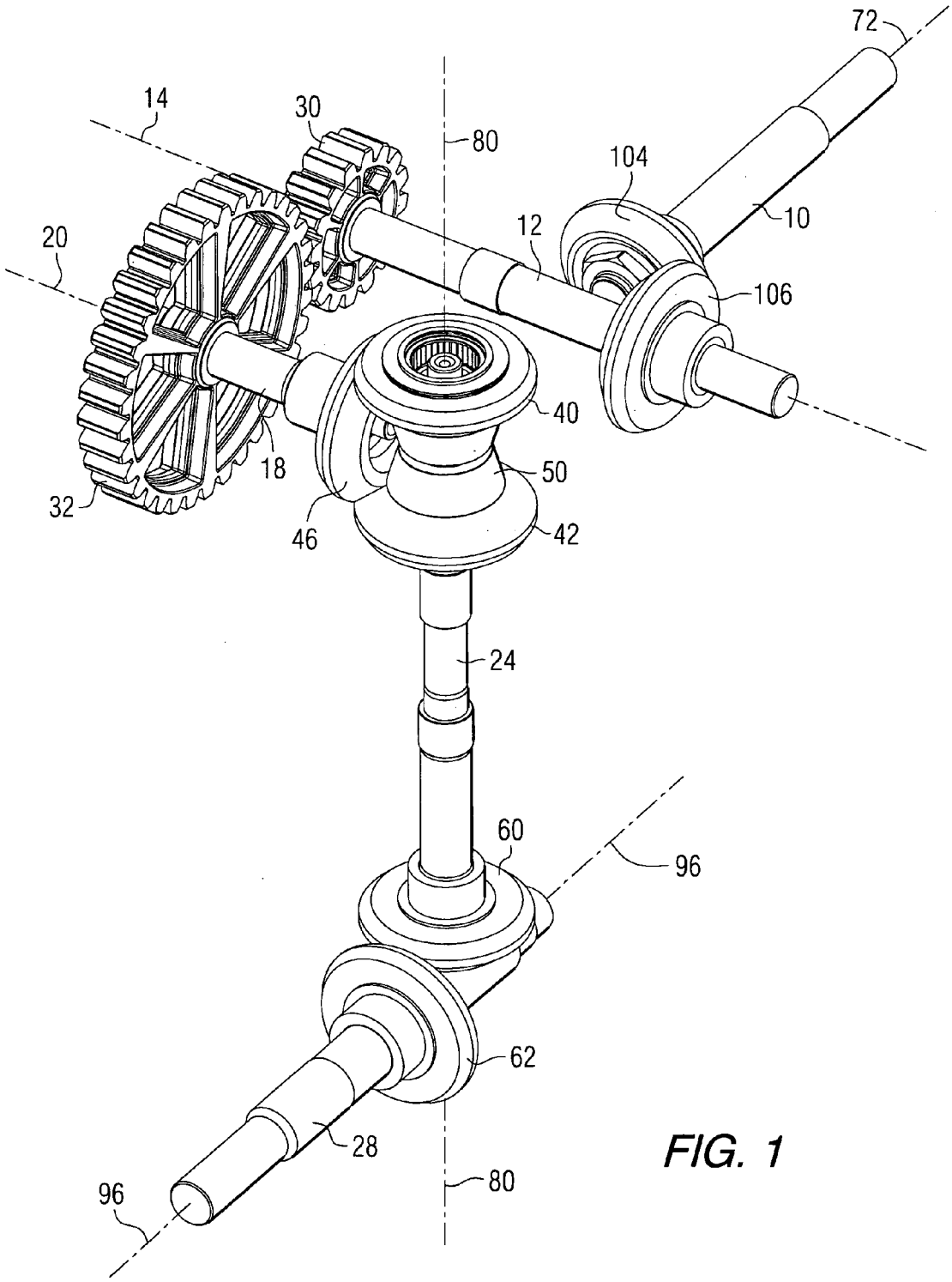
FIG. 1 shows the relative positions of the shafts, gears, and clutch of the present invention.

Throughout the description of the preferred embodiment of the present invention, like components will be identified by like reference numerals.

FIG. 1 is a highly simplified isometric representation of the basic concept of the present invention, but with only the shafts, gears, and clutch being shown. The other components of the present invention will be illustrated and described in detail below, but FIG. 1 is intended to simplify the explanation of the basic operation of the present invention.

As illustrated in FIG. 1, a marine propulsion system made in accordance with the present invention comprises an input shaft 10 which is connectable in torque transmitting relation with an internal combustion engine. A first intermediate shaft 12 is connected in torque transmitting relation with the input shaft 10 and is rotatable about a first axis of rotation 14. A second intermediate shaft 18 is connected in torque transmitting relation with the first intermediate shaft 12 and is rotatable about a second axis of rotation 20. The first and second axes of rotation, 14 and 20, are generally parallel to each other in a preferred embodiment. A drive shaft 24 is connectable in torque transmitting relation with the second intermediate shaft 18. A propeller shaft 28 is connected in torque transmitting relation with the drive shaft 24. In a particularly preferred embodiment of the present invention, the input shaft 10 is generally perpendicular to the first intermediate shaft 12.

A first spur gear 30 is attached to the first intermediate shaft 12 and a second spur gear 32 is attached to the second intermediate shaft 18. The first and second spur gears, 30 and 32, are connected in tooth meshing relation with each other. A first bevel gear 40 is connected in torque transmitting relation with the second intermediate shaft 18 to rotate in a first direction. A second bevel gear 42 is connected in torque transmitting relation with the second intermediate shaft 18 to rotate in a second direction. In a preferred embodiment, the first and second bevel gears, 40 and 42, are connected in tooth meshing relation with a bevel gear 46 that is attached to the second intermediate shaft 18. This bevel gear 46 and the first and second bevel gears, 40 and 42, are in constant rotation as long as the second intermediate shaft 18 is rotating about its axis of rotation 20. A clutch 50, which is illustrated as a cone clutch, is moveable between a first position to cause the drive shaft 24 to rotate in a first direction and a second position to cause the drive shaft 24 to rotate in a second direction. In a preferred embodiment, the clutch 50 is a cone clutch that can move into frictional driving relation with either the first bevel gear 40 or the second bevel gear 42. The clutch 50 is connected in torque transmitting relation with the drive shaft 24 by a plurality of spline teeth that transmits torque between the clutch 50 and the drive shaft 24. When the clutch 50 is moved upwardly into frictional driving relation with the first bevel gear 40, the drive shaft 24 rotates in the first direction along with the first bevel gear 40. Conversely, when the clutch 50 is moved downwardly into frictional driving relation with the second bevel gear 42, the drive shaft 24 moves in the second direction along with the second bevel gear 42. When the clutch 50 is in a central position, the drive shaft 24 is not rotated because of the lack of frictional driving relationship between the clutch 50 and either the first or second bevel gears, 40 or 42. The first bevel gear 40 is connected in torque transmitting relation with the drive shaft 24 when the clutch 50 is in the first position and the second bevel gear 42 is connected in torque transmitting relation with the drive shaft 24 when the clutch is in the second position.

Another significant advantage of the present invention relates to the first and second spur gears, 30 and 32, which are connected in tooth meshing relation with each other. These spur gears can be interchanged with other spur gears having different gear tooth ratios. As a result, the gear ratio of the entire system can be quickly and easily changed. Known systems require significant disassembly and reassembly to accomplish a gear ratio change.

The present invention further comprises a drive shaft bevel gear 60 which is attached to the drive shaft 24 and a propeller shaft bevel gear 62 which is attached to the propeller shaft 28. The drive shaft bevel gear 60 is disposed in tooth meshing relation with the propeller shaft bevel gear 62 in order to cause the propeller shaft 28 to rotate in a first or second direction in coordination with the drive shaft 24.

Figure 2:
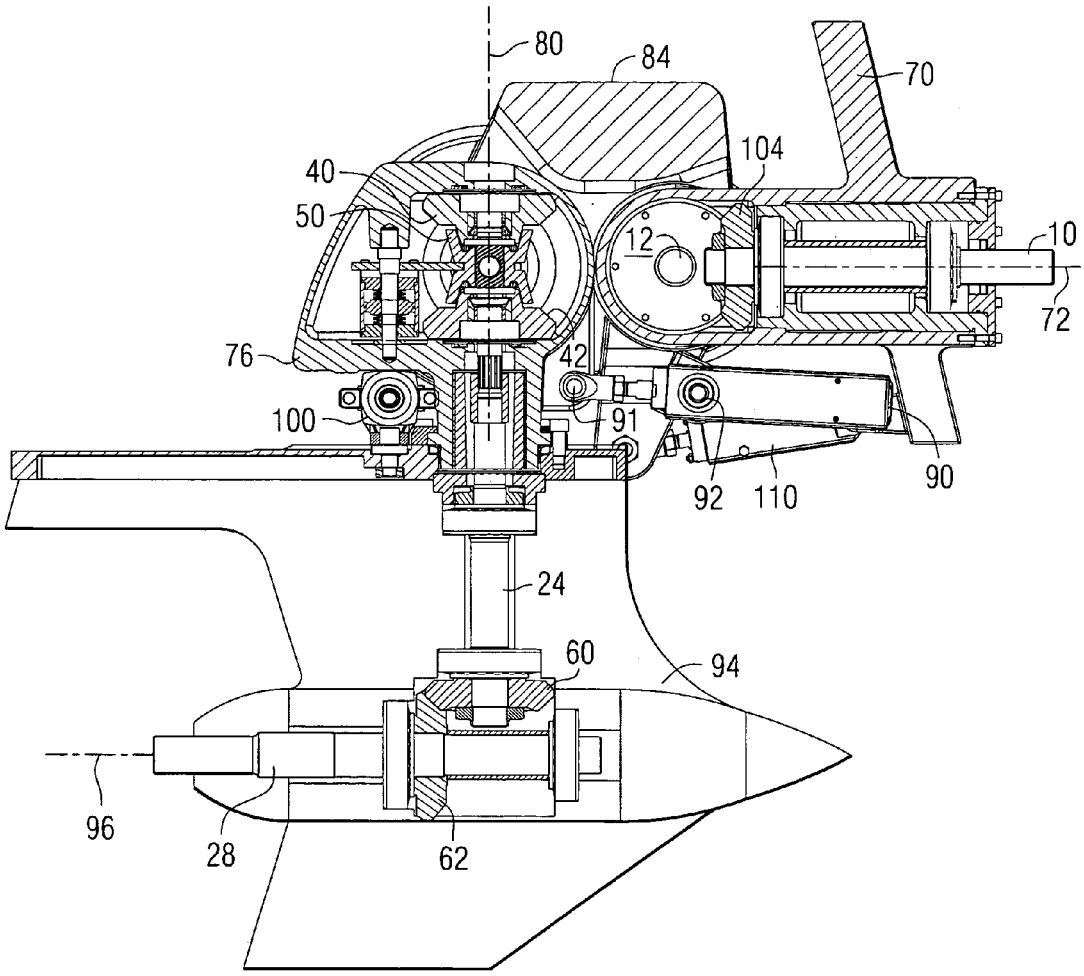
FIG. 2 is a side section view of a preferred embodiment of the present invention.

FIG. 2 is a side view which is sectioned to show some of the internal components of the present invention. Some of the components described above in conjunction with FIG. 1 are also visible in FIG. 2. They are identified by the same reference numerals used above in order to allow FIG. 1 to be compared to FIG. 2. FIG. 2 also shows a transom housing 70 which is attachable to a transom of a marine vessel. The input shaft 10 is supported for rotation about an input shaft axis 72. A drive shaft housing 76 is provided. The drive shaft 24 and the first and second bevel gears, 40 and 42, are supported for rotation about a drive shaft axis 80 by the drive shaft housing 76. It should be understood that the drive shaft 24 can be constructed of two pieces that are connectable to each other with a spline connection in order to make assembly and disassembly of the marine propulsion system easier. A lower portion of the drive shaft 24 extends downwardly toward the drive shaft bevel gear 60 and the upper portion of the drive shaft 24 extends toward the first and second bevel gears, 40 and 42. An intermediate housing 84 is also provided. The first and second intermediate shafts, 12 and 18, are supported for rotation about the first and second axes, 14 and 20, by the intermediate housing 84. With continued reference to FIG. 2, a first hydraulic cylinder 90 is connected between the drive shaft housing 76 and the intermediate housing 84. These connection points are identified by reference numerals 91 and 92, respectively, in FIG. 2.

A gearcase 94 is also provided. The propeller shaft 28 is supported for rotation about the propeller shaft axis of rotation 96 by the gearcase 94 and the propeller shaft bevel gear 62 is supported for rotation about the drive shaft axis 80. As will be described in greater detail below, the gearcase 94 is rotatable about axis 80 relative to the drive shaft housing 76. A hydraulic actuator 100 is connected between the drive shaft housing 76 and the gearcase 94 for causing the gearcase 94 to rotate about the drive shaft axis 80.

With continued reference to FIGS. 1 and 2, several important advantageous characteristics of the present invention can be seen. Because of the fact that torque is transmitted between the input shaft 10 and the first intermediate shaft 12, the intermediate housing 84 is rotatable about the axis 14 of the first intermediate shaft 12 relative to the transom housing 70. In addition, because of the relationship of the bevel gear 46 and the first and second bevel gears 40 and 42, the drive shaft housing 76 is rotatable about axis 20 of the second intermediate shaft 18 relative to the intermediate housing 84. The combination of these two axes of rotation, 14 and 20, with respect to the transom housing 70, the intermediate housing 84, and the drive shaft housing 76 provides a significant advantage because it allows the propeller shaft 28 to be raised or lowered without having to change the trim angle of the drive shaft 24.

With continued reference to FIG. 2, a second hydraulic cylinder 110 is connected between the transom housing 70 and the intermediate housing 84. The combined use of the first hydraulic cylinder 90 and the second hydraulic cylinder 110 allows the drive unit to be rotated about axis 14, axis 20, or both axes simultaneously. The second hydraulic cylinder is connected between the points identified by reference numerals 114 and 116.

Figure 3:
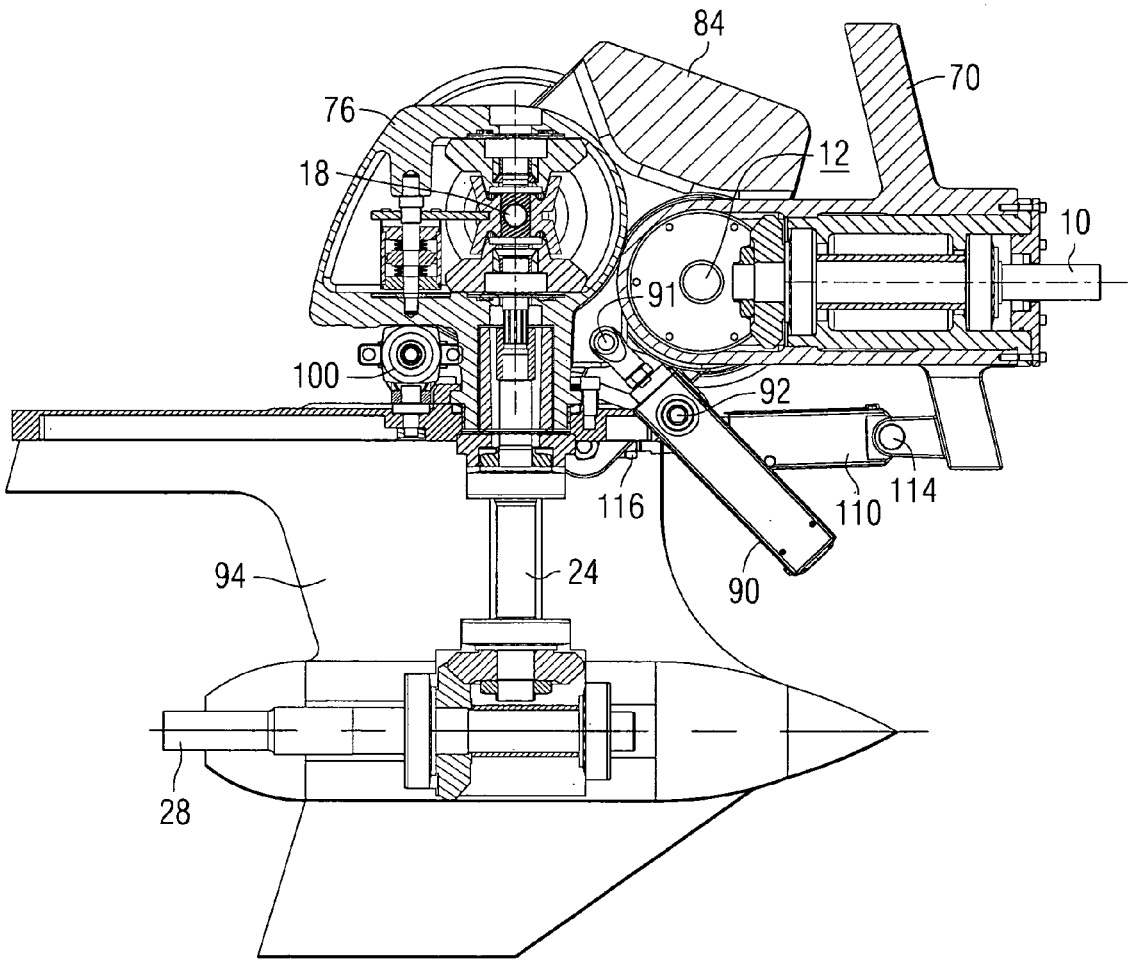
FIG. 3 is similar to FIG. 2 but with the gearcase raised.

FIG. 3 shows a drive unit after the intermediate housing 84 has been rotated clockwise relative to the transom housing 70 and the drive shaft housing 76 has been rotated counterclockwise by a similar magnitude, relative to the intermediate housing 84. This is accomplished by selective actuation of the first and second hydraulic cylinders, 90 and 110. It should be noted that the drive shaft 24 remains generally vertical, but the propeller shaft 28 is raised by the difference in height between the axes of rotation, 14 and 20, of the first and second intermediate shafts, 12 and 18.

Figure 4:
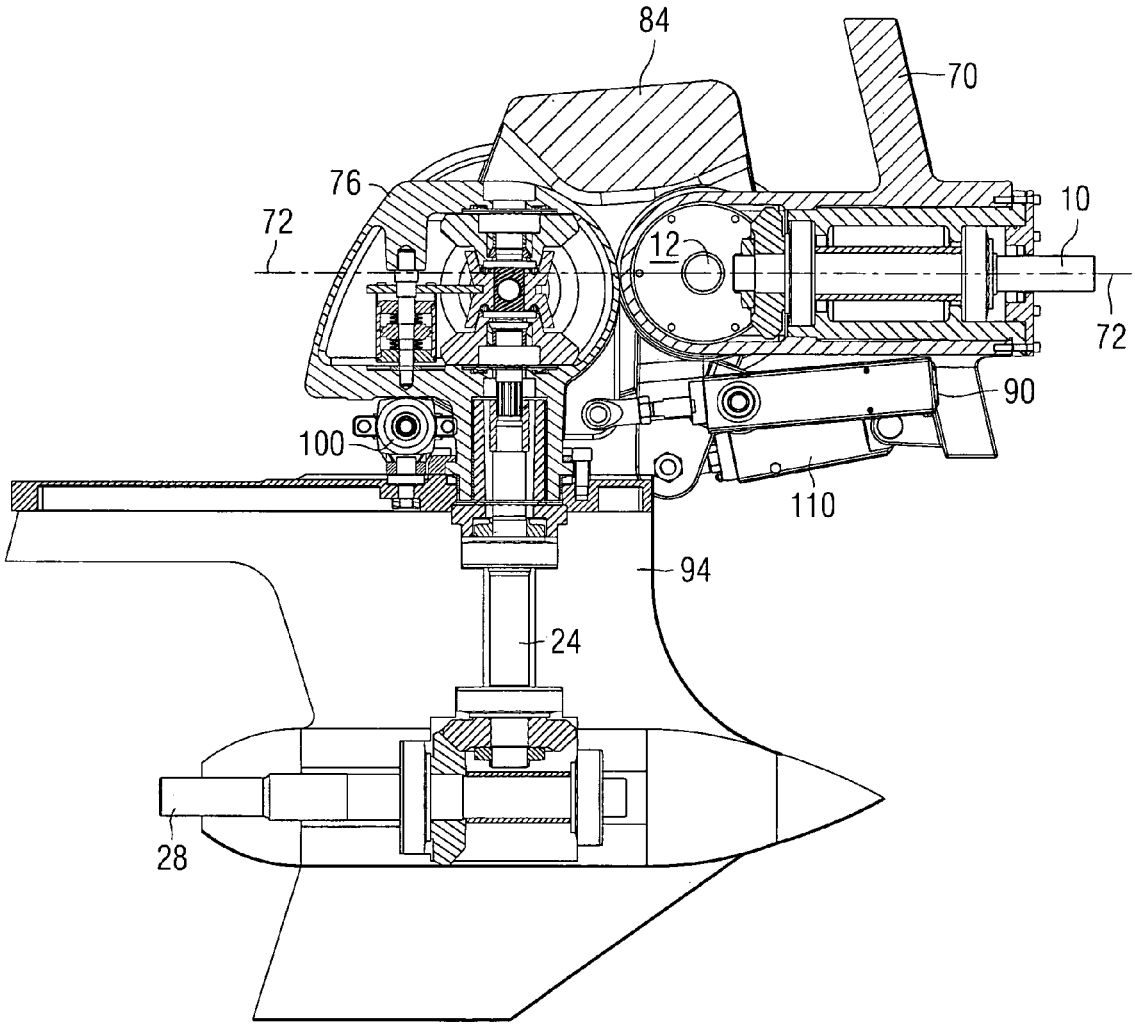
FIG. 4 shows the gearcase lowered in comparison to FIG. 3.

FIG. 4 shows the device described above in conjunction with FIGS. 2 and 3, but with the intermediate housing 84 rotated slightly about the centerline 14 of the first intermediate shaft 12 with a corresponding clockwise rotation of the drive shaft 76 relative to the intermediate shaft 14, about the centerline 20 of the second intermediate shaft 18. This lowers the position of the propeller shaft 28 while maintaining the drive shaft 24 in a generally vertical position. The slight lowering of the gearcase 94 can be seen by comparing the position of the second intermediate shaft 18 relative to axis 72 of the input shaft 10, which remains stationary during the trimming maneuver.

With reference to FIGS. 3 and 4, it can be seen that a raising maneuver as illustrated in FIG. 3 results in a slightly forward movement of the gearcase 94 toward the marine vessel to which it is attached. Similarly, a lowering of the gearcase 94 as described above in conjunction with FIG. 4 also results in a movement of the gearcase 94 toward the marine vessel. This results from the fact that the distance between the axes of rotation, 14 and 20, decreases, when measured along a horizontal plane, during both maneuvers. The maximum horizontal distance between axes 14 and 20 occurs when these two axes of rotation, or the first and second intermediate shafts, 12 and 18, are within the same horizontal plane. This is illustrated in FIG. 2.

Figure 5:
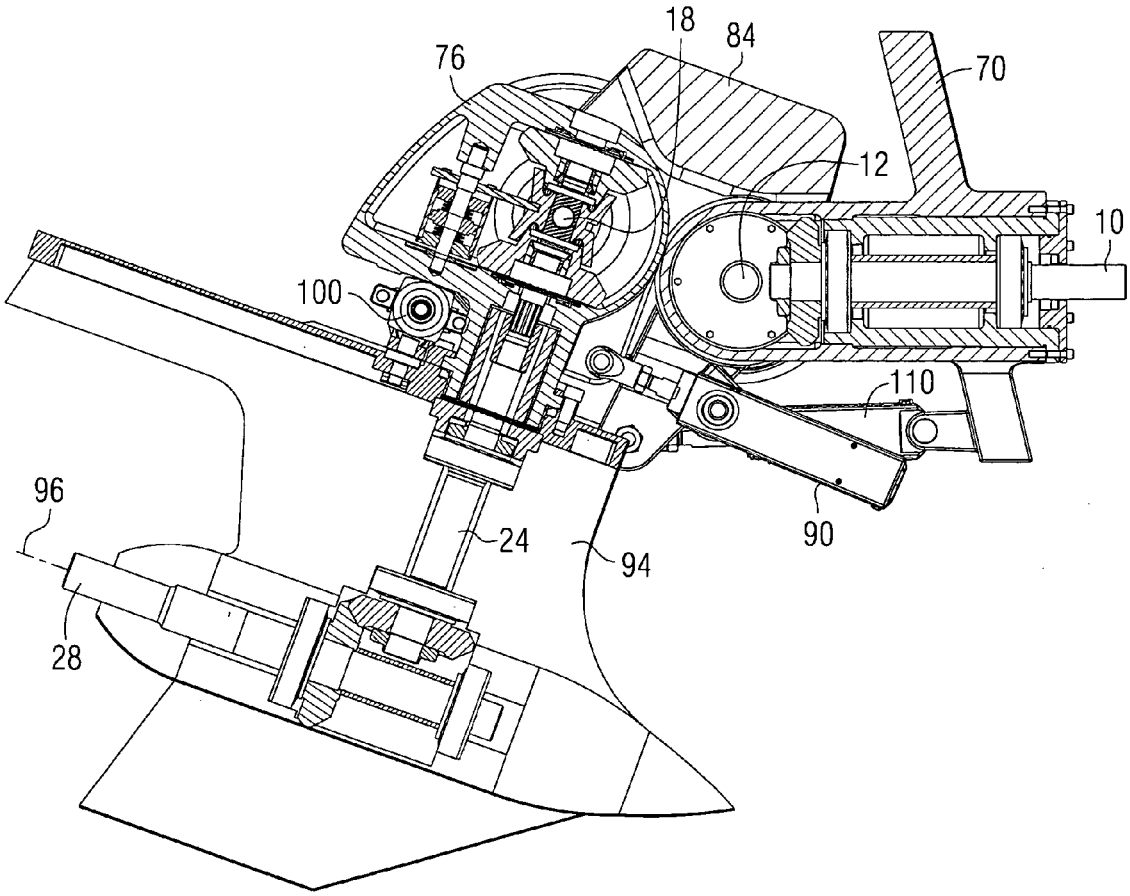
FIG. 5 shows the gearcase trimmed to place the drive shaft angle at a non-perpendicular angle relative to a horizontal plane.

FIG. 5 illustrates the use of the present invention to provide a trim angle with regard to the position of the drive shaft 24. The gearcase 94 is trimmed outwardly away from the marine vessel. This places the axis 96 of the propeller shaft 28 in a non-horizontal position as illustrated (i.e. not parallel to axis 72 of the input shaft 10). This is accomplished by rotating the intermediate housing 84 clockwise about the axis 14 of the first intermediate shaft 12 with little or no corresponding rotation of the drive shaft 76 relative to the intermediate housing 84.

Figure 6:
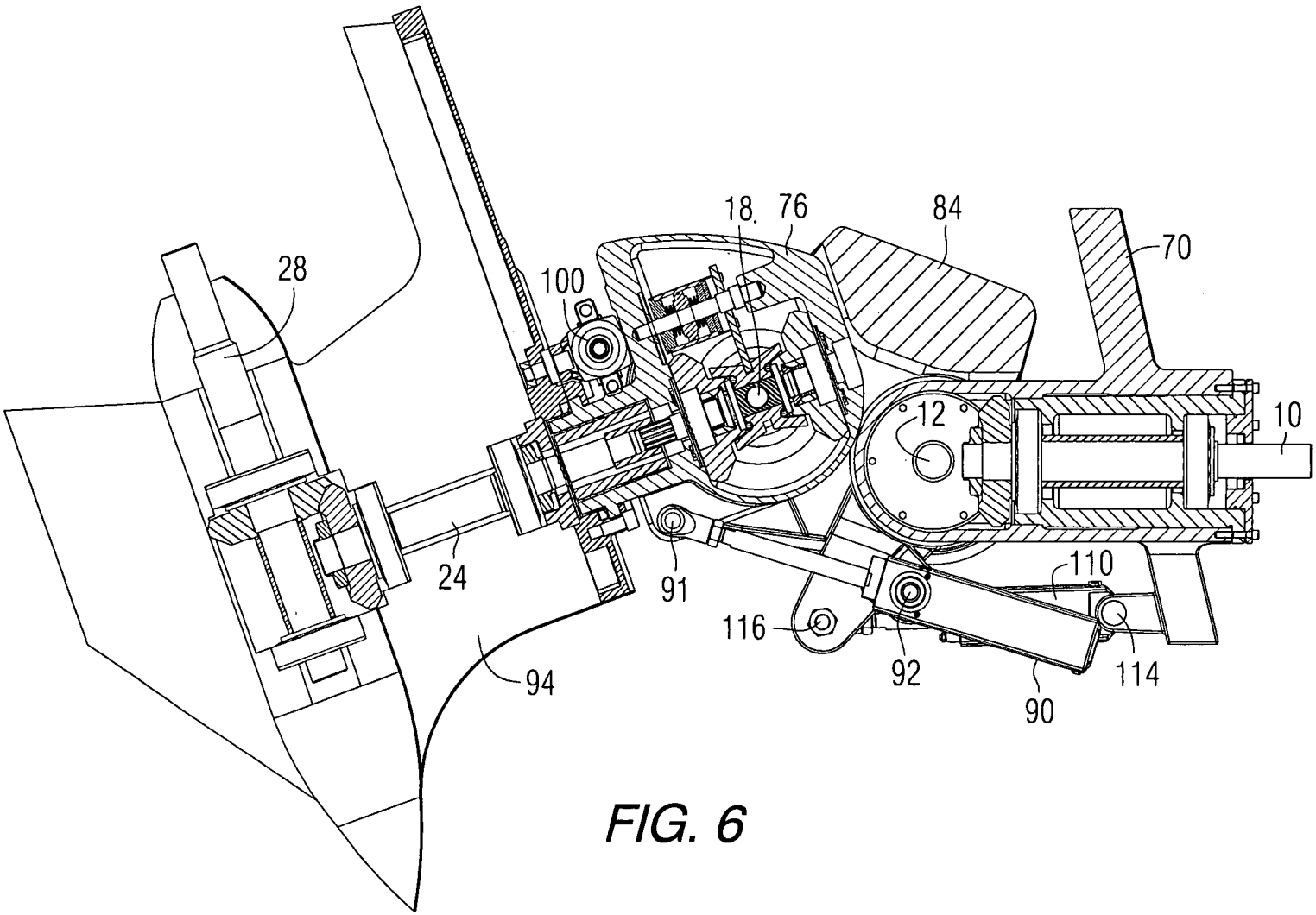
FIG. 6 shows the marine propulsion system tilted upward as it would be during storing or moving the marine vessel.

FIG. 6 shows a more extreme change in the position of the gearcase 94, when compared to FIG. 5. This position is accomplished by rotating the intermediate housing 84 in a clockwise direction about axis 14 of the first intermediate shaft 12 relative to the transom housing 70 while simultaneously rotating the drive shaft housing 76 in a clockwise direction about axis 20 of the second intermediate shaft 18. As described above, these two simultaneous rotations are accomplished by the first and second hydraulic cylinders, 90 and 110. It should be understood that the drive unit could be tilted upward even farther than illustrated as long as the intermediate housing is provided with sufficient clearance to allow this to occur. Since the system has no U-joint, there can be no limitation caused by the U-joint as with normal drive systems. This could allow the propeller to be changed while the boat is in the water. Also, the drive can be tilted upward sufficiently to lift the system out of salt water, thus minimizing corrosion.

With continued reference to FIG. 6, it can be seen that the first hydraulic cylinder 90 exerts a force between points 91 and 92 to rotate the drive shaft housing 76 relative to the intermediate housing 84. The second hydraulic cylinder 110 exerts a force between points 114 and 116 to rotate the intermediate housing 84 relative to the transom housing 70.

The relative positions of the various housings illustrated in FIGS. 2–6 show only a few of the many potential positions of the intermediate housing 84 and drive shaft housing 76 relative to the transom housing 70 and relative to each other. In this way, the gearcase 94 can be trimmed outwardly or inwardly, with a corresponding change in the angle of the axis of rotation 80 of the drive shaft 24. In addition, the gearcase 94 can be moved upwardly or downwardly without changing the angle of axis 80 to a horizontal plane. This allows a trim angle to be maintained while the gearcase 94 is moved upwardly or downwardly relative to the transom housing 70.

With continued to reference to FIGS. 2–6, it can be seen that actuation of the hydraulic actuator 100 can be used to cause the gearcase 94 to rotate about the drive shaft axis 80 in either a clockwise or counterclockwise direction to change the steering angle of the propeller shaft 28. When this occurs, the propeller shaft 28 and the propeller shaft bevel gear 62 rotate about the axis of rotation 80. As a result, the steering axis of the marine propulsion system remains perpendicular to the propeller shaft axis of rotation 96 and in intersecting relation with the propeller shaft 28.

With reference to FIGS. 1–6, it can be seen that a marine propulsion system made in accordance with the present invention comprises an input shaft 10 which is connectable in torque transmitting relation with an engine. It also comprises a first intermediate shaft 12 which is connected in torque transmitting relation with the input shaft 10 and is rotatable about a first axis of rotation 14. A second intermediate shaft 18 is connected in torque transmitting relation with the first intermediate shaft 12 and is rotatable about a second axis of rotation 20. As particularly illustrated in FIG. 1, the first and second axes of rotation are generally parallel to each other in a preferred embodiment of the present invention. A drive shaft 24 is connectable in torque transmitting relation with the second intermediate shaft 18. A propeller shaft 28 is connected in torque transmitting relation with the drive shaft 24. The input shaft 10 is generally perpendicular to the first intermediate shaft 12. The first and second spur gears, 30 and 32, are attached to the first and second intermediate shafts, 12 and 18, and are connected in tooth meshing relation with each other. A first bevel gear 40 is connected in torque transmitting relation with the second intermediate shaft 18, through the operation of bevel gear 46, and a second bevel gear 42 is connected in torque transmitting relation with the second intermediate shaft 18 through the operation of the bevel gear 46. A clutch 50 is moveable between a first position to cause the drive shaft 24 to rotate in a first direction and a second position to cause the drive shaft 24 to rotate in a second direction. The first bevel gear 40 is connected in torque transmitting relation with the drive shaft 24 when the clutch 50 is in the first position and the second bevel gear 42 is connected in torque transmitting relation with the drive shaft 24 when the clutch 50 is in the second position. The clutch is connected in torque transmitting relation with the drive shaft 24 by a plurality of splines that are formed on the clutch and on the drive shaft. A drive shaft bevel gear 60 is attached to the drive shaft 24 and the propeller shaft bevel gear 62 is attached to the propeller shaft 28. These two bevel gears are disposed in tooth meshing relation with each other.

With continued reference to FIGS. 1–6, a transom housing 70 is attachable to a transom of a marine vessel and the input shaft 10 is supported for rotation about an input shaft axis of rotation 72 by the transom housing 70. A drive shaft housing 76 is provided to support the drive shaft 24 and the first and second bevel gears, 40 and 42, for rotation about the drive shaft axis 80. An intermediate housing 84 is provided to support the first and second intermediate shafts, 12 and 18, for rotation about the first and second axes, 14 and 20. A first hydraulic cylinder 90 is connected between the drive shaft housing 76 and the intermediate housing 84. A gearcase 94 is provided and the propeller shaft 28 is supported for rotation about a propeller shaft axis of rotation 96 by the gearcase 94. The propeller shaft bevel gear 62 is supported for rotation about both the propeller shaft axis 96 and the drive shaft axis 80. A hydraulic actuator 100 is connected between the drive shaft housing 76 and the gearcase 94 for causing the gearcase 94 to rotate about the drive shaft axis of rotation 80. A second hydraulic cylinder 110 is connected between the transom housing 70 and the intermediate housing 84. The intermediate housing 84 is rotatable relative to the transom housing 70 and the drive shaft housing 76 is rotatable relative to the intermediate housing 84.

With continued reference to FIGS. 1–6, it can be seen that one of the primary advantages of the present invention is that the axes of rotation of the various housings relative to each other are coincident with axes of shafts that are used to transmit torque from the input shaft 10 to the propeller shaft 28. This eliminates the need for the use of U-joints and also allows the gearcase 94 to be raised or lowered without the necessity of the axis 80 being moved away from its current trim angle.

Although the present invention has been described with particular specificity and illustrated to show a particularly preferred embodiment, it should be understood that alternative embodiments are also within its scope.

I claim:

1. A marine propulsion system, comprising:

an input shaft which is connectable in torque transmitting relation with an engine;

a first intermediate shaft which is connected in torque transmitting relation with said input shaft and rotatable about a first axis of rotation;

a second intermediate shaft which is connected in torque transmitting relation with said first intermediate shaft and rotatable about a second axis of rotation; and a drive shaft which is connectable in torque transmitting relation with said second intermediate shaft;

a first bevel gear connected in torque transmitting relation with said second intermediate shaft to rotate in a first direction;

a second bevel gear connected in torque transmitting relation with said second intermediate shaft to rotate in a second direction; and a clutch which is movable between a first position to cause said drive shaft to rotate in said first direction and a second position to cause said drive shaft to rotate in said second direction;

a drive shaft housing, said drive shaft and said first and second bevel gears being supported for rotation about a drive shaft axis of rotation by said drive shaft housing;

an intermediate housing, said first and second intermediate shafts being supported for rotation about said first and second axes of rotation by said intermediate housing;

a first hydraulic cylinder connected between said drive shaft housing and said intermediate housing; and a propeller shaft connected in torque transmitting relation with said drive shaft.

2. The marine propulsion system of claim 1, wherein:

said input shaft is generally perpendicular to said first intermediate shaft.

3. The marine propulsion system of claim 1, further comprising:

a first spur gear attached to said first intermediate shaft; and a second spur gear attached to said second intermediate shaft, said first and second spur gears being connected in tooth meshing relation with each other.

4. The marine propulsion system of claim 1, wherein:

said first bevel gear is connected in torque transmitting relation with said drive shaft when said clutch is in said first position and said second bevel gear is connected in torque transmitting relation with said drive shaft when said clutch is in said second position.

5. The marine propulsion system of claim 1, wherein:

said clutch is connected in torque transmitting relation with said drive shaft by a plurality of splines formed on said clutch and on said drive shaft.

6. The marine propulsion system of claim 1, further comprising:

a drive shaft bevel gear attached to said drive shaft; and a propeller shaft bevel gear attached to said propeller shaft, said drive shaft bevel gear being disposed in tooth meshing relation with said propeller shaft bevel gear.

7. The marine propulsion system of claim 1, further comprising:

a transom housing which is attachable to a transom of a marine vessel, said input shaft being supported for rotation about an input shaft axis of rotation by said transom housing.

8. The marine propulsion system of claim 7, further comprising:

a gearcase, said propeller shaft being supported for rotation about a propeller shaft axis of rotation by said gearcase and said propeller shaft bevel gear being supported for rotation about said drive shaft axis of rotation by said gearcase.

9. The marine propulsion system of claim 8, further comprising:

a hydraulic actuator connected between said drive shaft housing and said gearcase for causing said gearcase to rotate about said drive shaft axis of rotation.

10. The marine propulsion system of claim 9, further comprising:

a second hydraulic cylinder connected between said transom housing and said intermediate housing.

11. The marine propulsion system of claim 10, wherein:

said intermediate housing is rotatable relative to said transom housing.

12. The marine propulsion system of claim 1, wherein:

said drive shaft housing is rotatable relative to said intermediate housing.

13. A marine propulsion system, comprising:

a transom housing which is attachable to a transom of a marine vessel;

an intermediate housing, said intermediate housing being rotatable about a first axis of rotation relative to said transom housing; and a drive shaft housing, said drive shaft housing being rotatable about a second axis of rotation relative to said intermediate housing:

an input shaft which is connectable in torque transmitting relation with an engine, said input shaft being supported for rotation about an input shaft axis of rotation by said transom housing;

a first intermediate shaft which is connected in torque transmitting relation with said input shaft and rotatable about said first axis of rotation;

a second intermediate shaft which is connected in torque transmitting relation with said first intermediate shaft and rotatable about said second axis of rotation, said first and second intermediate shafts being supported for rotation about said first and second axes of rotation by said intermediate housing;

a drive shaft which is connectable in torque transmitting relation with said second intermediate shaft;

a propeller shaft connected in torque transmitting relation with said drive shaft;

a first spur gear attached to said first intermediate shaft; and a second spur gear attached to said second intermediate shaft, said first and second spur gears being connected in tooth meshing relation with each other.

14. The marine propulsion system of claim 13, further comprising:

a first bevel gear connected in torque transmitting relation with said second intermediate shaft to rotate in a first direction;

a second bevel gear connected in torque transmitting relation with said second intermediate shaft to rotate in a second direction, said drive shaft and said first and second bevel gears being supported for rotation about a drive shaft axis of rotation by said drive shaft housing; and a clutch which is movable between a first position to cause said drive shaft to rotate in ft said first direction and a second position to cause said drive shaft to rotate in a said second direction.

15. The marine propulsion system of claim 14, wherein:

said first bevel gear is connected in torque transmitting relation with said drive shaft when said clutch is in said first position and said second bevel gear is connected in torque transmitting relation with said drive shaft when said clutch is in said second position.

16. The marine propulsion system of claim 15, wherein:

said clutch is connected in torque transmitting relation with said drive shaft by a plurality of splines formed on said clutch and on said drive shaft.

17. The marine propulsion system of claim 16, further comprising:

a drive shaft bevel gear attached to said drive shaft; and a propeller shaft bevel gear attached to said propeller shaft, said drive shaft bevel gear being disposed in tooth meshing relation with said propeller shaft bevel gear.

18. The marine propulsion system of claim 17, further comprising:

a gearcase, said propeller shaft being supported for rotation about a propeller shaft axis of rotation by said gearcase and said propeller shaft bevel gear being supported for rotation about said drive shaft axis of rotation by said gearcase.

19. The marine propulsion system of claim 18, further comprising:

a first hydraulic cylinder connected between said drive shaft housing and said intermediate housing;

a second hydraulic cylinder connected between said transom housing and said intermediate housing; and a hydraulic actuator connected between said drive shaft housing and said gearcase for causing said gearcase to rotate about said drive shaft axis of rotation.

20. A marine propulsion system, comprising:

an input shaft which is connectable in torque transmitting relation with an engine;

a drive shaft which is connectable in torque transmitting relation with said input shaft;

a propeller shaft connected in torque transmitting relation with said drive shaft, said propeller shaft being rotatable about a drive shaft axis of rotation;

a drive shaft housing, said drive shaft being supported for rotation about said drive shaft axis of rotation by said drive shaft housing; and a gearcase, said propeller shaft being supported for rotation about a propeller shaft axis of rotation by said gearcase, said gearcase being rotatable about said drive shaft axis of rotation relative to said drive shaft housing:

a first intermediate shaft which is connected in torque transmitting relation with said input shaft and rotatable about a first axis of rotation; and a second intermediate shaft which is connected in torque transmitting relation with said first intermediate shaft and rotatable about a second axis of rotation, said first and second axes of rotation being generally parallel to each other.

21. The marine propulsion system of claim 20, further comprising:

a hydraulic actuator connected between said drive shaft housing and said gearcase for causing said gearcase to rotate about said drive shaft axis of rotation.

22. The marine propulsion system of claim 20, wherein:

said input shaft is generally perpendicular to said first intermediate shaft.

23. The marine propulsion system of claim 22, further comprising:

a first spur gear attached to said first intermediate shaft;

a second spur gear attached to said second intermediate shaft, said first and second spur gears being connected in tooth meshing relation with each other;

a first bevel gear connected in torque transmitting relation with said second intermediate shaft to rotate in a first direction;

a second bevel gear connected in torque transmitting relation with said second intermediate shaft to rotate in a second direction; and a clutch which is movable between a first position to cause said drive shaft to rotate in a said first direction and a second position to cause said drive shaft to rotate in a said second direction.

24. The marine propulsion system of claim 23, wherein:

said first bevel gear is connected in torque transmitting relation with said drive shaft when said clutch is in said first position and said second bevel gear is connected in torque transmitting relation with said drive shaft when said clutch is in said second position.

25. The marine propulsion system of claim 24, wherein:

said clutch is connected in torque transmitting relation with said drive shaft by a plurality of splines formed on said clutch and on said drive shaft.

26. The marine propulsion system of claim 25, further comprising:

a drive shaft bevel gear attached to said drive shaft; and a propeller shaft bevel gear attached to said propeller shaft, said drive shaft bevel gear being disposed in tooth meshing relation with said propeller shaft bevel gear.

27. The marine propulsion system of claim 26, further comprising:

a transom housing which is attachable to a transom of a marine vessel, said input shaft being supported for rotation about an input shaft axis of rotation by said transom housing; and an intermediate housing, said first and second intermediate shafts being supported for rotation about said first and second axes of rotation by said intermediate housing.

28. The marine propulsion system of claim 27, further comprising:

a first hydraulic cylinder connected between said drive shaft housing and said intermediate housing; and a second hydraulic cylinder connected between said transom housing and said intermediate housing.

29. The marine propulsion system of claim 28, wherein:

said intermediate housing is rotatable relative to said transom housing.

30. The marine propulsion system of claim 29, wherein:

said drive shaft housing is rotatable relative to said intermediate housing.

* * * * *